US012158315B2

(12) United States Patent
Noonan

(10) Patent No.: US 12,158,315 B2
(45) **Date of Patent: *Dec. 3, 2024**

(54) BOLT HOLD OPEN MECHANISM SYSTEM AND METHOD OF USING IT

(71) Applicant: F.M. Products Inc, Boise, ID (US)

(72) Inventor: Paul T. Noonan, Boise, ID (US)

(73) Assignee: F.M. Products Inc, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/149,376

(22) Filed: Jan. 14, 2021

(65) Prior Publication Data

US 2021/0270555 A1 Sep. 2, 2021

Related U.S. Application Data

(63) Continuation of application No. 16/212,158, filed on Dec. 6, 2018, now Pat. No. 10,921,077.

(51) Int. Cl.
*F41A 17/36* (2006.01)
*F41A 3/66* (2006.01)

(52) U.S. Cl.
CPC ..... *F41A 17/36* (2013.01); *F41A 3/66* (2013.01)

(58) Field of Classification Search
CPC ..... F41A 17/36; F41A 3/66
USPC ..... 89/138
See application file for complete search history.

(56) References Cited

U.S. PATENT DOCUMENTS 2,571,132 A * 10/1951 Harvey ..... F41A 3/26 42/69.03
3,540,142 A * 11/1970 Billett ..... F41A 17/36 42/22
4,057,003 A * 11/1977 Atchisson ..... F41A 3/26 89/138
4,069,608 A * 1/1978 Jurek ..... F41A 9/71 42/49.02
4,128,042 A * 12/1978 Atchisson ..... F41A 3/26 89/138
6,510,778 B1 * 1/2003 Irwin ..... F41A 15/12 42/16
6,606,811 B1 * 8/2003 Olson ..... F41A 17/36 42/50
7,661,219 B1 * 2/2010 Knight, Jr. ..... F41A 3/42 42/70.02
8,359,966 B1 * 1/2013 Brotherton ..... F41A 17/36 42/70.02
8,387,296 B2 * 3/2013 Overstreet ..... F41A 17/36 42/50
8,695,477 B2 * 4/2014 Esch ..... F41A 17/42 42/14
9,091,499 B2 * 7/2015 Overstreet ..... F41A 3/68
9,194,637 B2 * 11/2015 Mather ..... F41A 17/38
D816,180 S * 4/2018 Farris ..... D22/108
2011/0247483 A1 * 10/2011 Overstreet ..... F41A 9/70 89/138
2012/0167424 A1 * 7/2012 Gomez ..... F41A 17/42 42/14

(Continued)

*Primary Examiner* — Joshua E Freeman

(57) ABSTRACT

A bolt hold open mechanism assembly is disclosed. The bolt hold open mechanism assembly contains a connector rod, a follower lever associated with the connector rod, a bolt stop associated with the connector rod, and a lifter lever comprising at least one protrusion configured to interact with a magazine follower.

5 Claims, 16 Drawing Sheets

(56) References Cited

U.S. PATENT DOCUMENTS

| | | | | |
|---|---|---|---|---|
| 2014/0325886 | A1* | 11/2014 | Mather | F41A 17/38<br>42/6 |
| 2017/0160032 | A1* | 6/2017 | Overstreet | F41A 17/36 |
| 2017/0241729 | A1* | 8/2017 | Gangl | F41A 3/66 |
| 2017/0299303 | A1* | 10/2017 | Phipps | F41A 3/66 |
| 2018/0156556 | A1* | 6/2018 | Wyssen | F41A 35/06 |

* cited by examiner

BOLT HOLD OPEN MECHANISM SYSTEM AND METHOD OF USING IT

CROSS REFERENCE TO RELATED APPLICATIONS

This application claims the benefit of U.S. Provisional Application No. 62/296,077, filed on Feb. 17, 2016, which is incorporated herein by reference in its entirety. This application is a continuation of U.S. patent application Ser. No. 15/434,742 titled "Bolt Hold Open Mechanism System and Method of Using It" filed Feb. 16, 2017, now issued U.S. Pat. No. 10,180,298, which is incorporated herein by reference in its entirety. This application is a continuation of U.S. patent application Ser. No. 16/212,158 titled "Bolt Hold Open Mechanism System and Method of Using It" filed Dec. 6, 2018, now issued U.S. Pat. No. 10,921,077, which is incorporated herein by reference in its entirety.

FIELD

The present invention relates to a bolt hold open mechanism system. More particularly, the present invention relates to a bolt hold open mechanism system capable of preventing the bolt and the bolt carrier assembly from moving forward to battery upon firing and ejecting the last round from the ammunition feeding device or magazine.

BACKGROUND

Armalite style rifles (ARs) are a very popular shooting platform for shooting enthusiasts around the world. The AR style platform can be easily customized to accommodate any user's preferences. One such popular customization is an AR style upper and lower receivers designed to shoot pistol caliber rounds.

The pistol caliber ARs have a number of weaknesses. On of these is the lack of a bolt stop or bolt catch feature that prevents the bolt and the bolt carrier assembly from moving forward to battery upon firing and ejecting the last round from the ammunition feeding device or magazine. This shortcoming often leads to the users unanticipated running out of ammunition unless the user counts the number of bullets fired from the magazine. In most cases, this results in a dry fire, where the trigger is pulled on an empty chamber. This slows down the operators response time to refresh the firearms magazine. Not having a bolt stop or bolt catch feature deviates from the standard AR manual of arms.

What is needed is a system that can prevent the bolt carrier from moving forward upon firing/ejecting of the last round of ammunition thereby mimicking the standard operation and manual of arms of AR style rifles.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
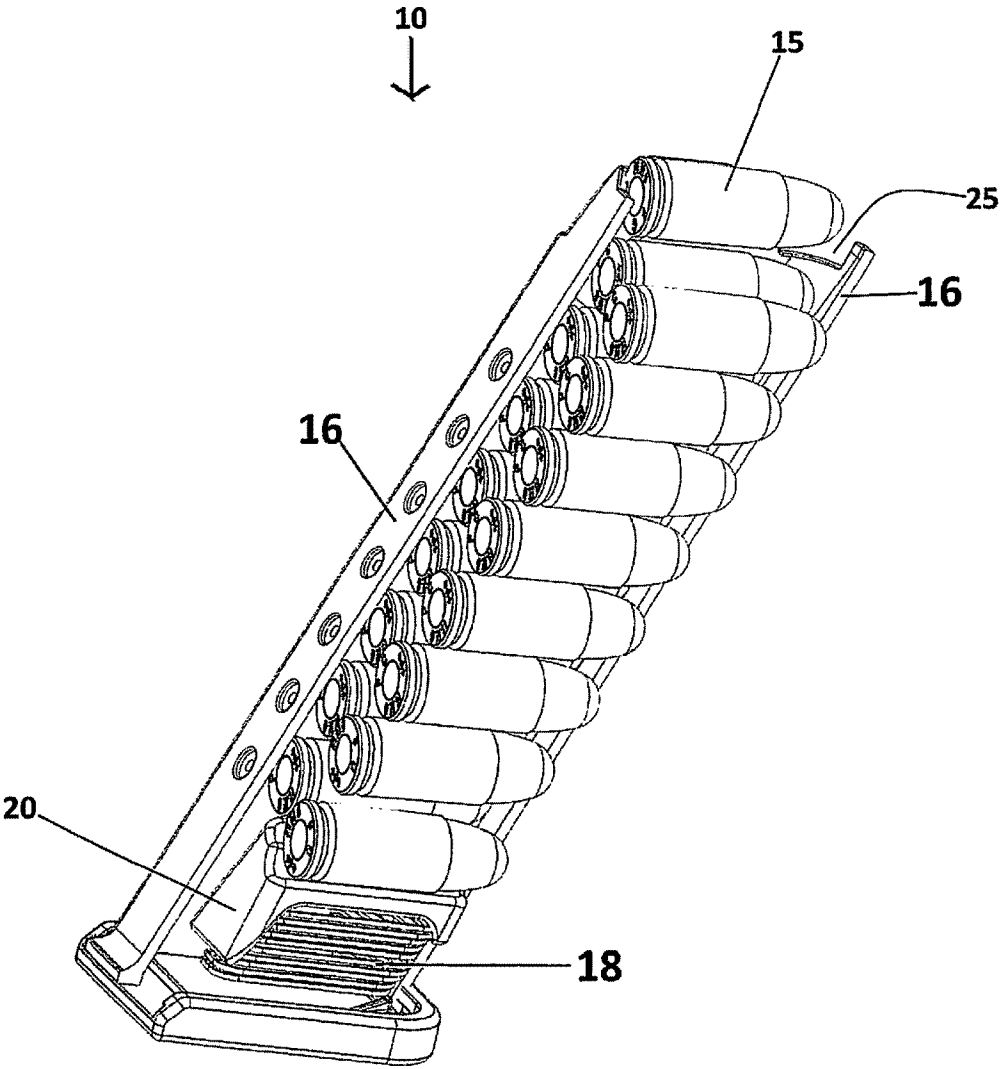
FIGURE 1 PRIOR ART
FIG. 1 depicts a cutaway view of an ammunition magazine as known in the art.

As know in the art, an ammunition magazine 10 (cutaway portion shown in FIG. 1) is commonly employed to hold a number of rounds of ammunition 15 and feed each round to a chamber in a gun (not shown) for subsequent firing. The magazine 10 has a spring-loaded magazine follower 20 positioned along a passage created by the sidewalls 16 of the magazine 10. Ammunition 15 is loaded through a magazine opening 25 into the passage on top of the magazine follower 20 with the associated spring 18 positioned beneath the magazine follower 20 in a compressed state. Typically, this arrangement successively urges each round of ammunition 15 loaded on top of the magazine follower 20 into a gun chamber (now shown).

Figure 2A:
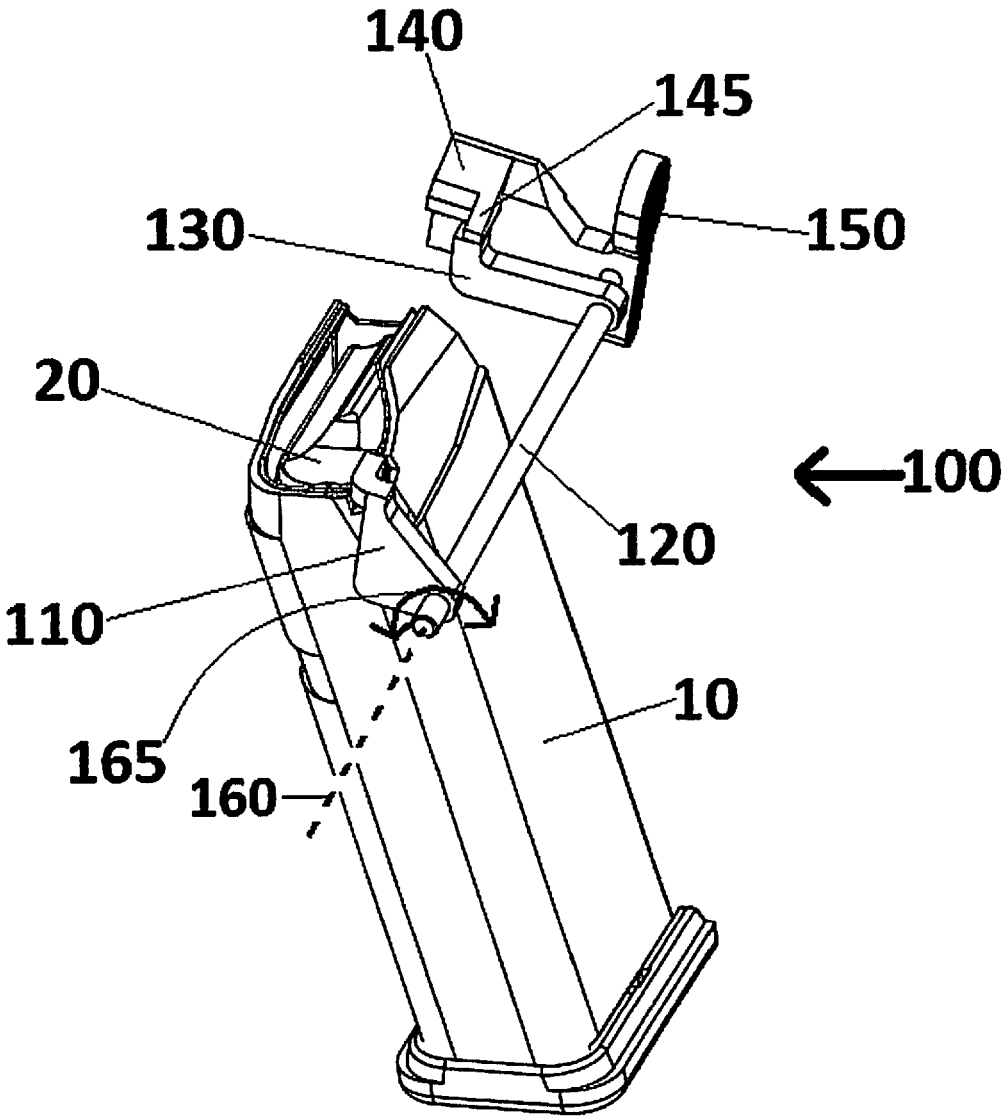
FIG. 2A depicts a bolt hold open mechanism assembly according to present disclosure.
Figure 2B:
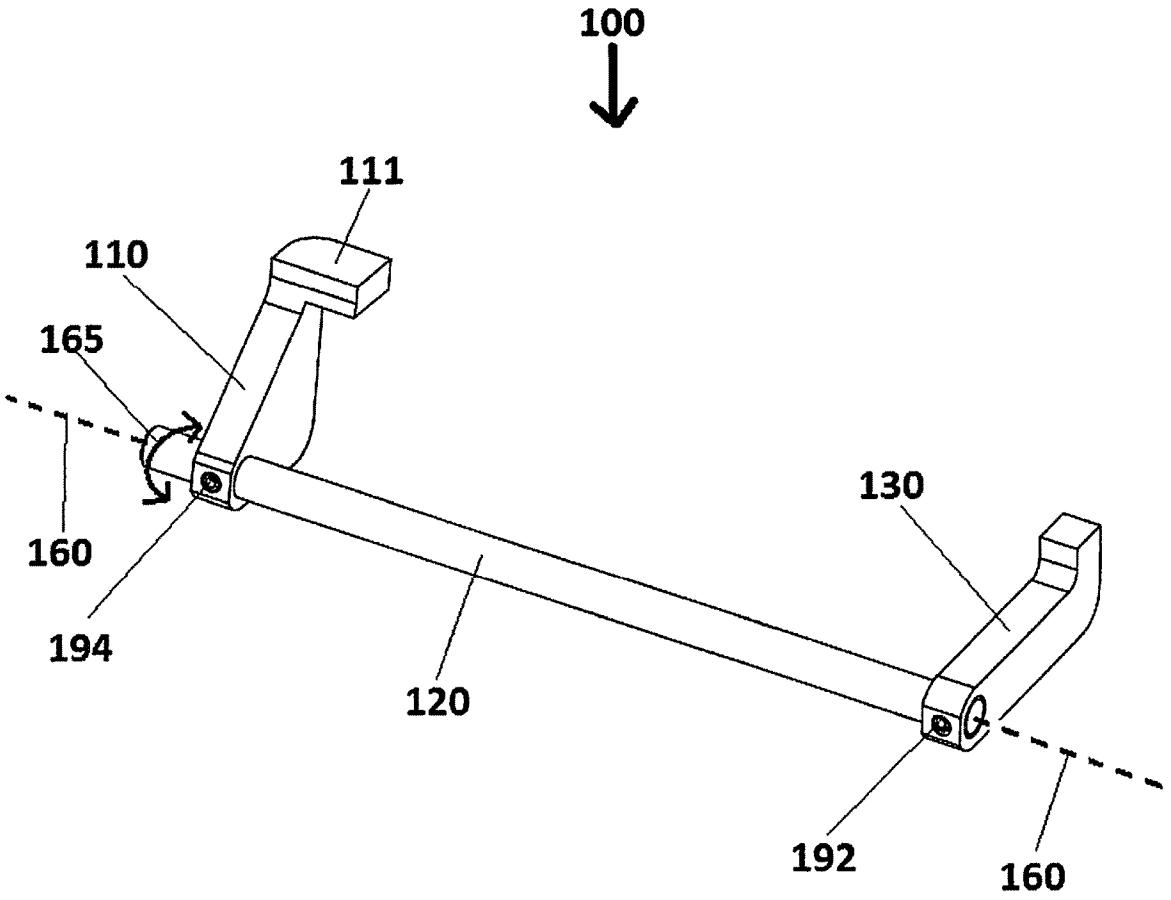
FIG. 2B depicts another view of the bolt hold open mechanism assembly shown in FIG. 2A.

Referring to FIGS. 2A-B, a bolt hold open mechanism assembly 100 is shown according to some embodiments presently disclosed. The bolt hold open mechanism assembly 100 comprises a follower lever 110, a connector rod 120 and a bolt stop lever 130. According to some embodiments presently disclosed, the connector rod 120 couples the follower lever 110 with the bolt stop lever 130. The connector rod 120 comprises a longitudinal axis 160 running along the length of the connector rod 120. The connector rod 120 is configured to rotate about the axis 160 as shown by reference number 165. According to some embodiments, the connector rod 120 is configured to rotate from a first angular position to a second angular position and vise versa about the axis 160 as shown by reference number 165. The first angular position may be separated from the second angular position by about 15 degrees to 30 degrees.

Figure 4:
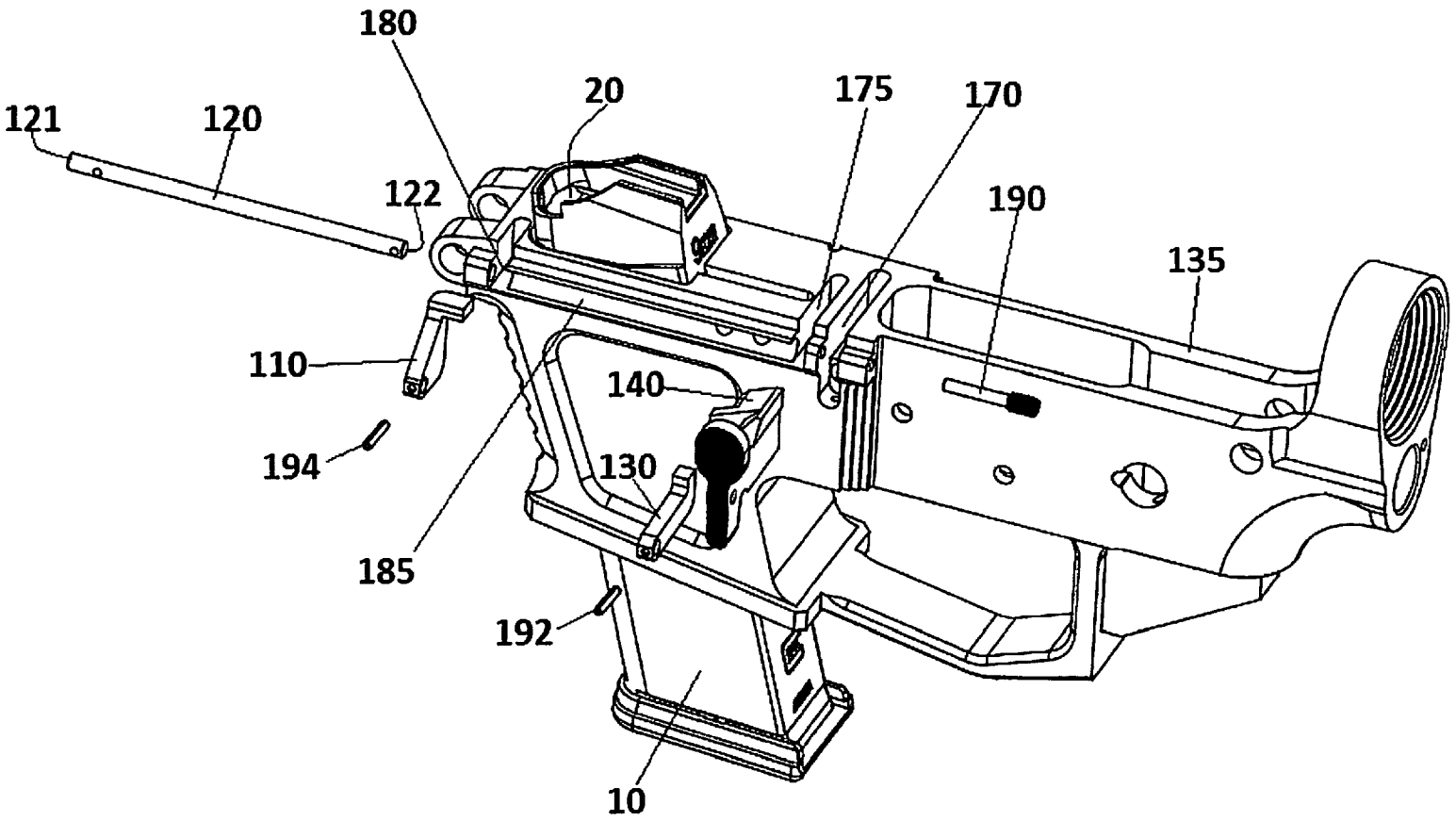
FIG. 4 depicts another sectional perspective of the lower receiver shown in FIG. 3.

According to some embodiments, the connector rod 120 comprises a first end 121 and a second end 122 (shown in FIG. 4). According to some embodiments, the follower lever 110 is positioned adjacent to the first end 121 and the bolt stop lever 130 is positioned adjacent to the second end 122.

Figure 3:
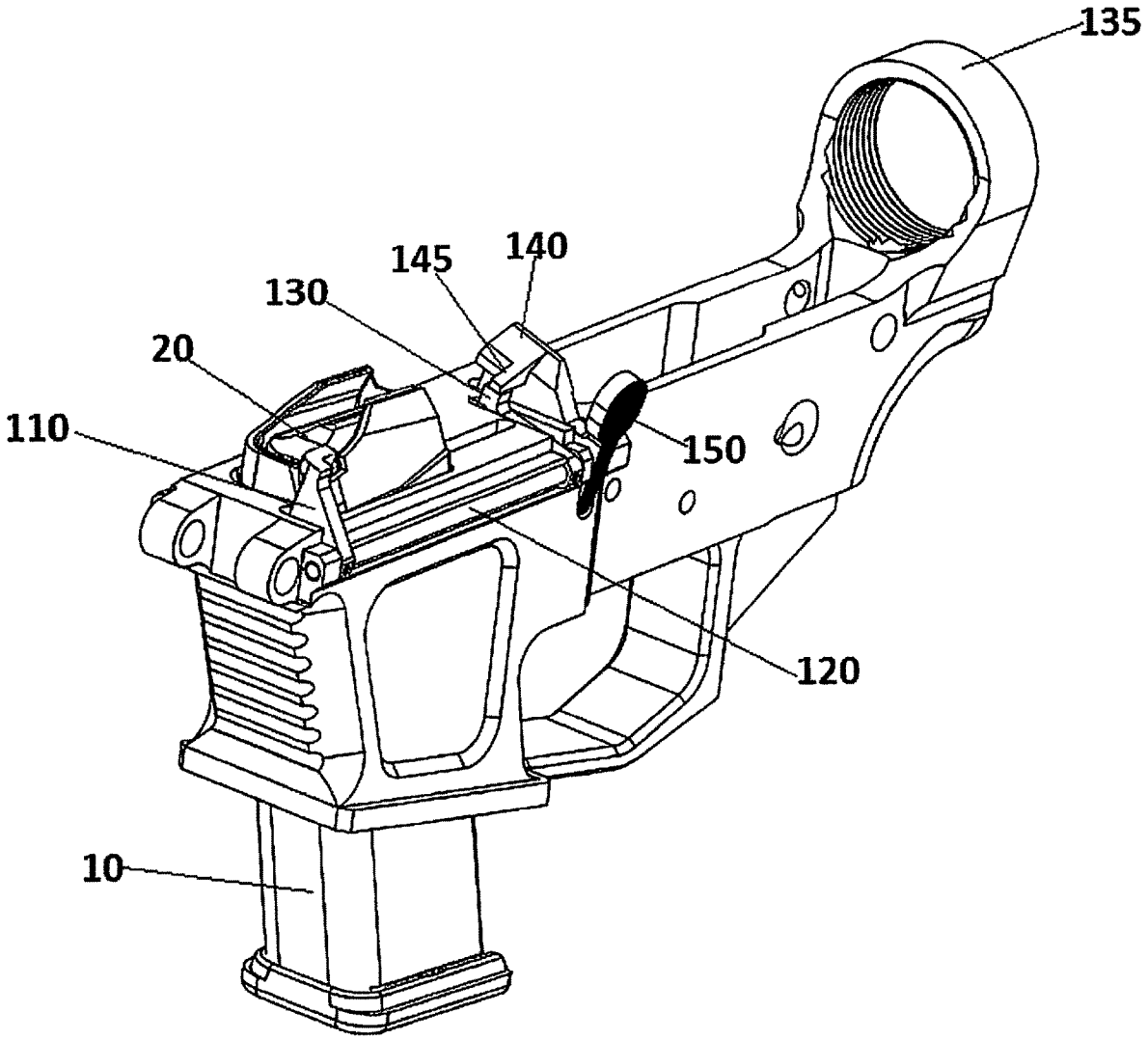
FIG. 3 depicts a sectional perspective of a lower receiver according to the present disclosure.

Referring to FIG. 3, a sectional perspective is shown of a lower receiver 135 with the follower lever 110 positioned adjacent to the magazine 10 and the bolt stop lever 130 positioned adjacent to a bolt catch 140.

The bolt catch 140 is configured to move from a first (open) position to a second (blocking) position. According to some embodiments, at least a portion of the bolt catch 140 moves vertically from the first (open) position to the second (blocking) position. When the bolt catch 140 is in the first (open) position, the bolt (not shown) and the bolt carrier assembly (not shown) are able to freely move forward to battery upon firing and ejecting the rounds 15. When the bolt catch 140 is in the second (blocking) position, the bolt and the bolt carrier assembly are prevented from moving forward to battery. The bolt catch 140 may also comprise a thumb-actuated portion 150 to allow the user (i.e. operator of the firearm) to manually move the bolt catch 140 between the first and second positions and back. According to some embodiments, the bolt hold open mechanism assembly 100 may comprise a bolt stop detent (not shown) and a bolt stop detent spring (not shown) to prevent the bolt catch 140 accidently moving to the second (blocking) position during the firing of the gun.

The bolt catch 140 may also comprise one or more protrusions 145. According to some embodiments, the bolt stop lever 130 is configured to interact with the one or more protrusions 145 and cause the bolt catch 140 to move from the first (open) position to the second (blocking) position. According to some embodiments, at least a portion of the bolt stop lever 130 is configured to move from a first (lower) position to a second (raised) position. According to some embodiments, the bolt stop lever 130 is configured to move rotationally about the axis 160 of the connector rod 120 as shown by reference number 165.

According to some embodiments, at least a portion of the follower lever 110 is configured to move from a first (inactive) position to a second (active) position. According to some embodiments, the follower lever 110 is configured to move rotationally about the axis 160 of the connector rod 120 as shown by reference number 165. According to some embodiments, the follower lever 110 is configured to remain in the first (inactive) position as long as there is at least one round 15 in the magazine 10. According to some embodiments, when the last round 15 is fired/ejected from the magazine 10, the magazine follower 20 is configured to move the follower lever 110 from the first (inactive) position to the second (active) position. According to some embodiments, the follower lever 110 comprises at least one protrusion 111 configured to interact with the magazine follower 20 when the last round 15 is fired/ejected from the magazine 10. According to some embodiments, when the last round 15 is fired/ejected from the magazine 10, the magazine follower 20 is configured to interact with the protrusion 111 and move the follower lever 110 from the first (inactive) position to the second (active) position.

According to some embodiments, a portion of the follower lever 110 interacts with the magazine follower 20 when the last round 15 is fired/ejected from the magazine 10. According to some embodiments, when the last round 15 is fired/ejected from the magazine 10, the magazine follower 20 is configured to interact with the portion of the follower lever 110 and move the follower lever 110 from the first (inactive) position to the second (active) position.

According to some embodiments, when the last round 15 is fired/ejected from the magazine 10, the magazine follower 20 is configured to activate the bolt hold open mechanism assembly 100 by moving the follower lever 110 from the first (inactive) position to the second (active) position. Moving the follower lever 110 from the first (inactive) position to the second (active) position causes the connector rod 120 to rotate about the longitudinal axis 160 as shown by reference number 165. Rotation of the connector rod 120 about the longitudinal axis 160 causes the bolt stop lever 130 to move from the first (lower) position to the second (raised) position. Moving the bolt stop lever 130 from the first (lower) position to the second (raised) position causes the bolt catch 140 to move vertically from a first (open) position to a second (blocking) position. Moving the bolt catch 140 to the second (blocking) position prevents the bolt and the bolt carrier assembly from moving forward to battery.

According to some embodiments, when the last round 15 is fired/ejected from the magazine 10, the magazine follower 20 is configured to activate the bolt hold open mechanism assembly 100 by moving the follower lever 110 from the first (inactive) position to the second (active) position. Moving the follower lever 110 from the first (inactive) position to the second (active) position causes the connector rod 120 to rotate from a first angular position to a second angular position. Rotation of the connector rod 120 from the first angular position to the second angular position causes the bolt stop lever 130 to move from the first (lower) position to the second (raised) position. Moving the bolt stop lever 130 from the first (lower) position to the second (raised) position causes the bolt catch 140 to move vertically from a first (open) position to a second (blocking) position. Moving the bolt catch 140 to the second (blocking) position prevents the bolt and the bolt carrier assembly from moving forward to battery.

According to some embodiments, when the user replaces the empty magazine 10 with a magazine containing one or more rounds 15, the user's activation of the thumb-actuated portion 150 manually moves the bolt catch 140 from the second (blocking) position to the first (open) position to allow the bolt and the bolt carrier assembly to move forward to battery. Moving the bolt catch 140 to the first (open) position causes the bolt stop lever 130 to move from the second (raised) position to the first (lower) position. Moving the bolt stop lever 130 to the first (lower) position) causes the connector rod 120 to rotate about the longitudinal axis 160 as shown by reference number 165. Rotation of the connector rod 120 about the longitudinal axis 160 causes the follower lever 110 to move from the second (active) position to the first (inactive) position. Moving the follower lever 110 to the first (inactive) position resets the bolt hold open mechanism assembly 100 until it is once again activated by the magazine follower 20 after the last round 15 is fired/ejected from the magazine 10.

According to some embodiments, when the user replaces the empty magazine 10 with a magazine containing one or more rounds 15, the user's activation of the thumb-actuated portion 150 manually moves the bolt catch 140 from the second (blocking) position to the first (open) position to allow the bolt and the bolt carrier assembly to move forward to battery. Moving the bolt catch 140 to the first (open) position causes the bolt stop lever 130 to move from the second (raised) position to the first (lower) position. Moving the bolt stop lever 130 to the first (lower) position) causes the connector rod 120 to rotate from the second angular position to the first angular position. Rotation of the connector rod 120 from the second angular position to the first angular position causes the follower lever 110 to move from the second (active) position to the first (inactive) position. Moving the follower lever 110 to the first (inactive) position resets the bolt hold open mechanism assembly 100 until it is once again activated by the magazine follower 20 after the last round 15 is fired/ejected from the magazine 10.

Referring to FIG. 4, according to some embodiments, the lower receiver 135 comprises a bolt catch channel 170 to accommodate the bolt catch 140. According to some embodiments, the lower receiver 135 comprises a bolt stop lever channel 175 to accommodate the bolt stop lever 130. According to some embodiments, the lower receiver 135 comprises a follower lever channel 180 to accommodate the follower lever 110.

Referring to FIG. 4, according to some embodiments, the lower receiver 135 comprises a connector rod channel 185 to accommodate the connector rod 120. The connector rod channel 185 is configured to allow the connector rod 120 to rotate about the axis 160. According to some embodiments, the connector rod channel 185 is configured to allow the connector rod 120 to rotate from the first angular position to the second angular position and vise versa. According to some embodiments, the connector rod channel 185 is disposed on the external side of the lower receiver 135. According to some embodiments, the connector rod channel 185 is covered to prevent dirt from interfering with the operation of the bolt hold open mechanism assembly 100.

Referring to FIG. 4, according to some embodiments, the bolt catch 140 is coupled with the lower receiver 135 using a threaded bolt stop pin 190. According to some embodiments, the bolt stop lever 130 is coupled with the connector rod 120 using a coiled spring pin 192. According to some embodiments, the follower lever 110 is coupled with the connector rod 120 using a coiled spring pin 194.

According to some embodiments, the bolt stop lever 130, the connector rod 120 and the follower lever 110 are cast from a single piece of metal (not shown).

Figure 5:
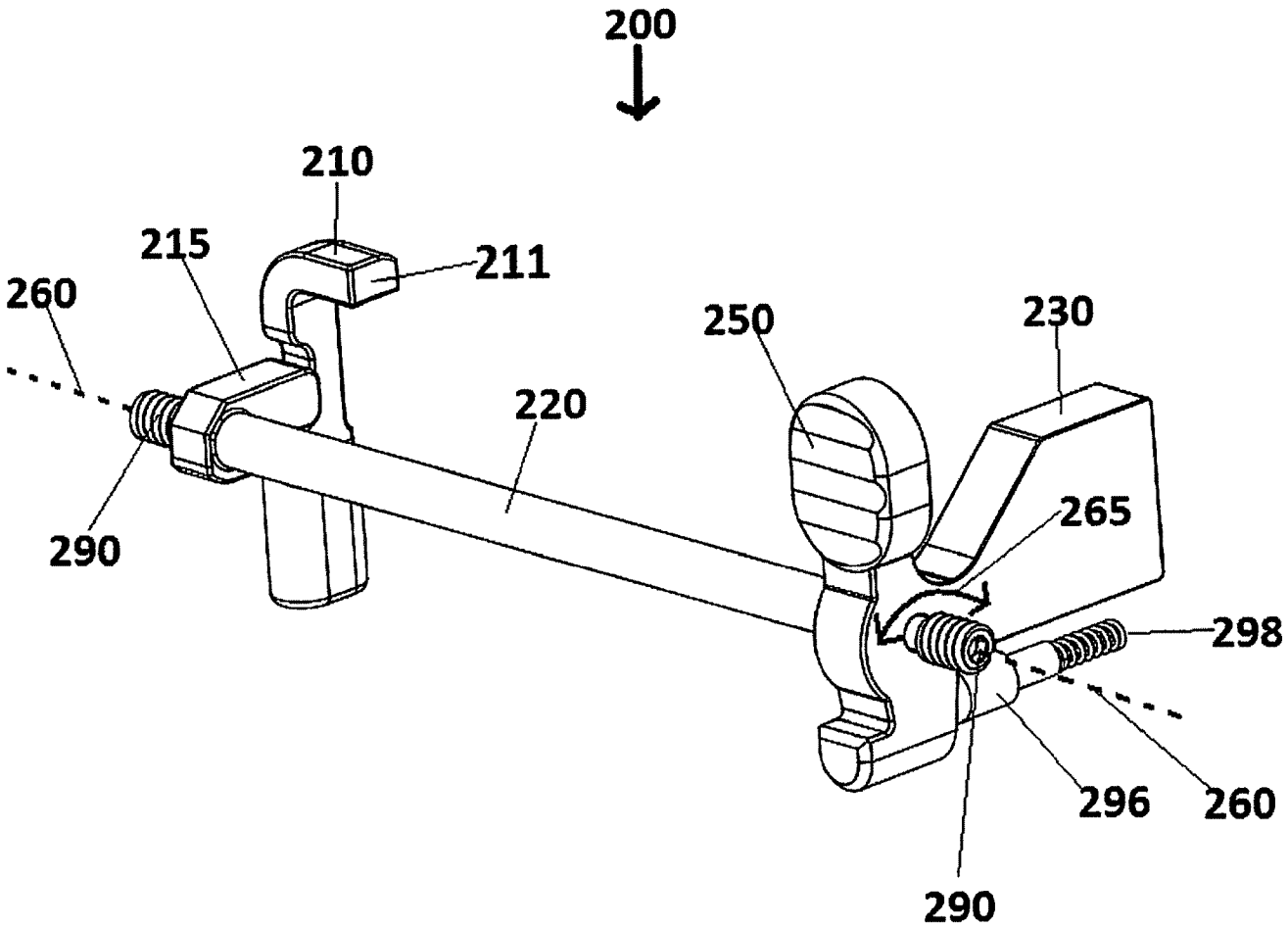
FIG. 5 depicts another bolt hold open mechanism assembly according to the present disclosure.
Figure 6:
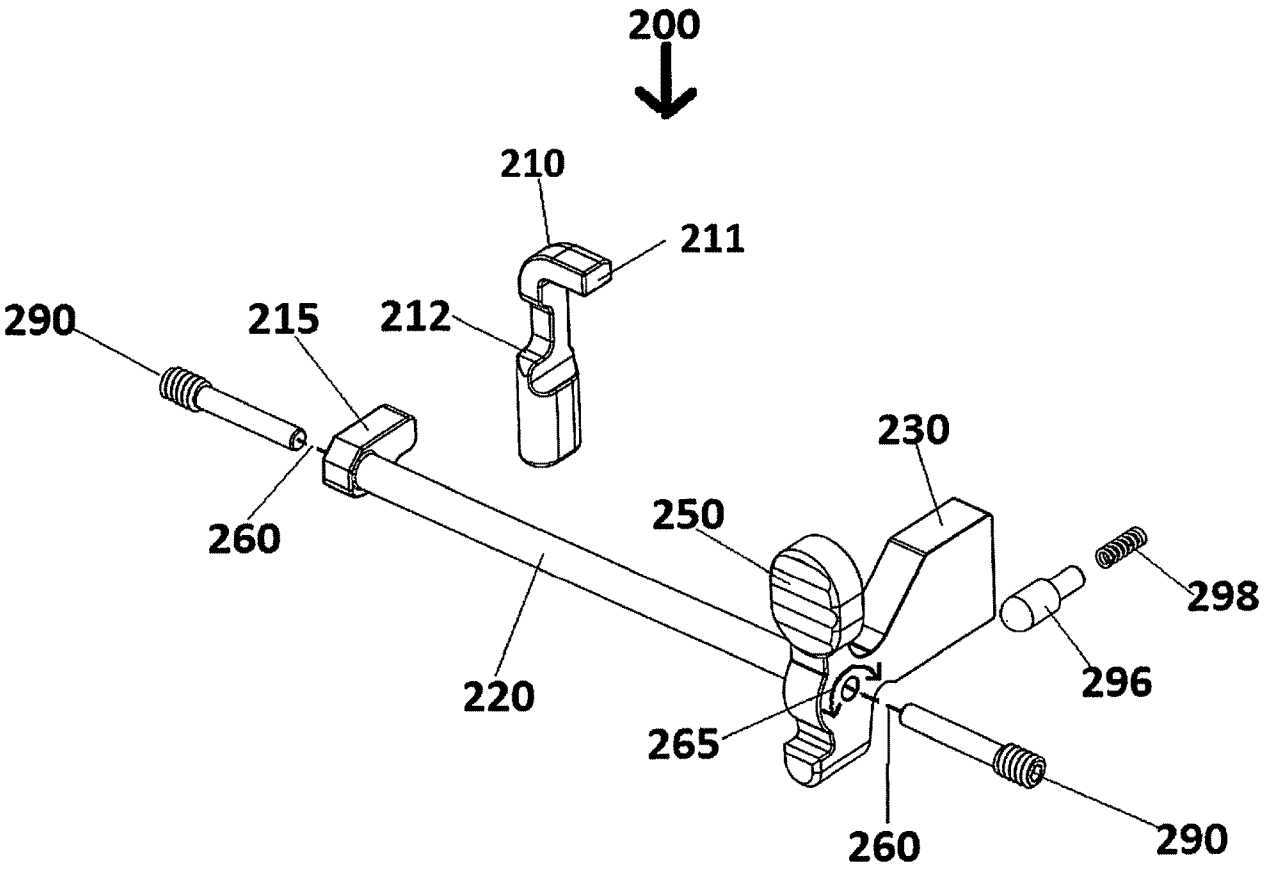
FIG. 6 depicts another view of the bolt hold open mechanism assembly shown in FIG. 5.

Referring to FIGS. 5-6, a bolt hold open mechanism assembly 200 is shown according to some embodiments presently disclosed. The bolt hold open mechanism assembly 200 comprises a lifter lever 210, a follower lever 215, a connector rod 220 and a bolt stop 230. According to some embodiments presently disclosed, the connector rod 220 couples the follower lever 215 with the bolt stop 230. The connector rod 220 comprises a longitudinal axis 260 running along the length of the connector rod 220. The connector rod 220 is configured to rotate about the axis 260 as shown by reference number 265. According to some embodiments, the connector rod 220 is configured to rotate from a first angular position to a second angular position and vise versa about the axis 260 as shown by reference number 265. The first angular position may be separated from the second angular position by about 15 degrees to 30 degrees.

Figure 9:
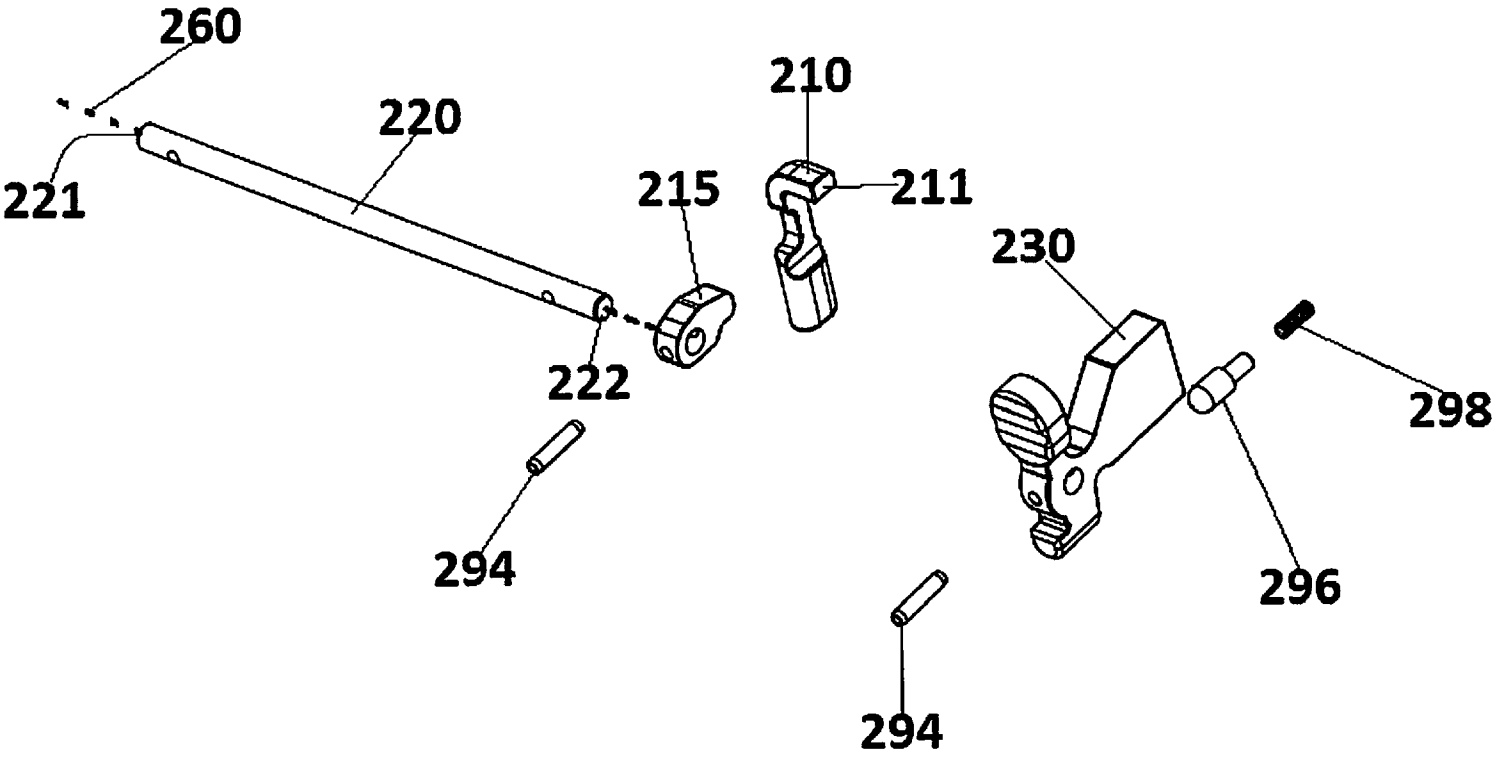
FIG. 9 depicts another bolt hold open mechanism assembly according to the present disclosure.
Figure 10:
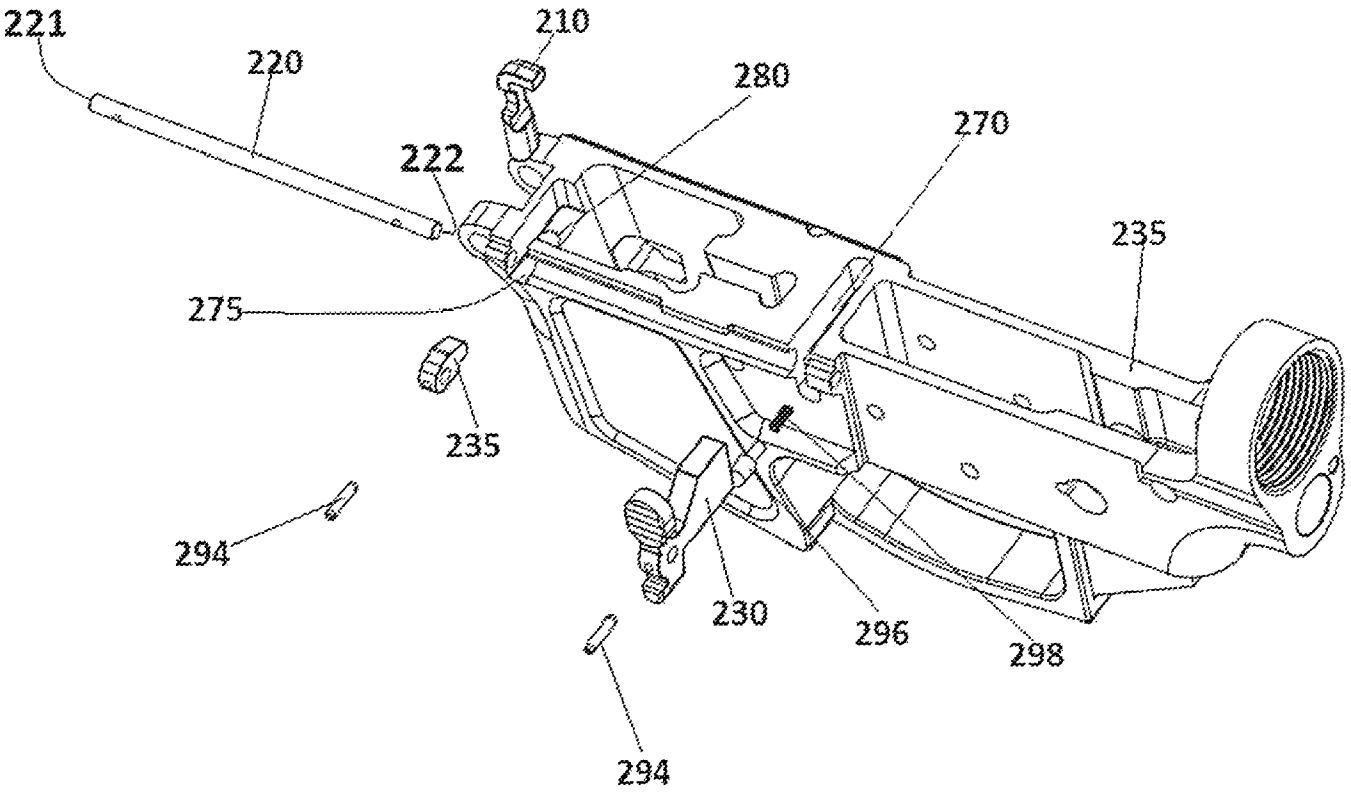
FIG. 10 depicts another sectional perspective of a lower receiver according to the present disclosure.

According to some embodiments, the connector rod 220 comprises a first end 221 and a second end 222 (shown in FIGS. 9-10). According to some embodiments, the lifter lever 210 is positioned adjacent to the first end 221 and the bolt stop 230 is positioned adjacent to the second end 222.

Figure 7:
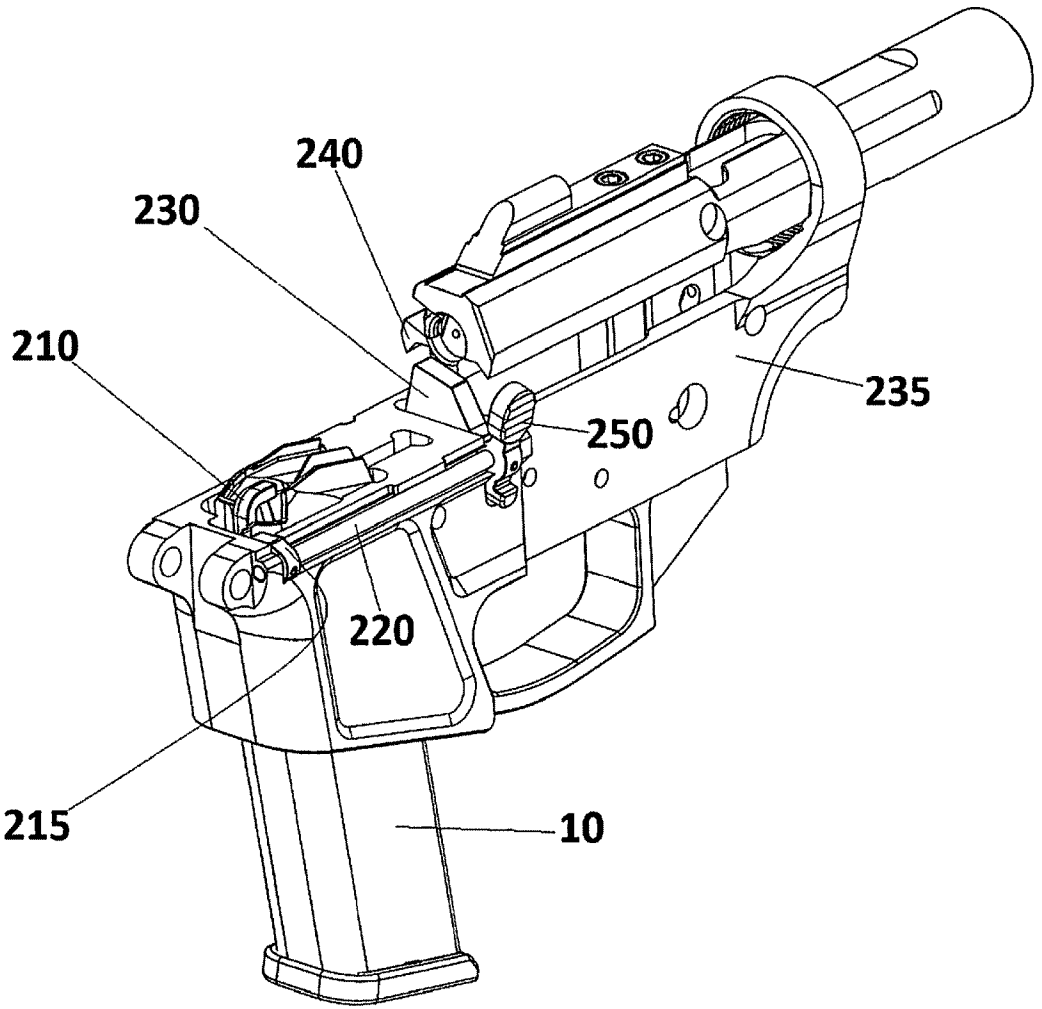
FIG. 7 depicts another sectional perspective of a lower receiver according to the present disclosure.

Referring to FIG. 7, a sectional perspective is shown of a lower receiver 235 with the lifter lever 210 positioned adjacent to the magazine 10 and the bolt stop 230 positioned adjacent to a bolt 240.

The bolt stop 230 is configured to move from a first (open) position to a second (blocking) position. According to some embodiments, at least a portion of the bolt stop 230 moves vertically from the first (open) position to the second (blocking) position. When the bolt stop 230 is in the first (open) position, the bolt 240 and the bolt carrier assembly are able to freely move forward to battery upon firing and ejecting the rounds 15. When the bolt stop 230 is in the second (blocking) position, the bolt 240 and the bolt carrier assembly are prevented from moving forward to battery. The bolt stop 230 may also comprise a thumb-actuated portion 250 to allow the user (i.e. operator of the firearm) to manually move the bolt stop 230 between the first (open) and second (blocking) positions and back. According to some embodiments, the bolt stop 230 is configured to move rotationally about the axis 260 of the connector rod 220 as shown by reference number 265.

According to some embodiments, the lifter lever 210 is configured to move from a first (inactive) position to a second (active) position. According to some embodiments, the lifter lever 210 is configured to move vertically between the first (inactive) position and the second (active) position. According to some embodiments, the lifter lever 210 is configured to remain in the first (inactive) position as long as there is at least one round 15 in the magazine 10. According to some embodiments, when the last round 15 is fired/ejected from the magazine 10, the magazine follower 20 is configured to move the lifter lever 210 from the first (inactive) position to the second (active) position. According to some embodiments, the lifter lever 210 comprises at least one protrusion 211 configured to interact with the magazine follower 20 when the last round 15 is fired/ejected from the magazine 10. According to some embodiments, when the last round 15 is fired/ejected from the magazine 10, the magazine follower 20 is configured to interact with the protrusion 211 and move the lifter lever 210 from the first (inactive) position to the second (active) position.

According to some embodiments, a portion of the lifter lever 210 interacts with the magazine follower 20 when the last round 15 is fired/ejected from the magazine 10. According to some embodiments, when the last round 15 is fired/ejected from the magazine 10, the magazine follower 20 is configured to interact with the portion of the lifter lever 210 and move the lifter lever 210 from the first (inactive) position to the second (active) position.

According to some embodiments, the lifter lever 210 comprises a support section 212 to support at least a portion of the follower lever 215.

According to some embodiments, at least a portion of the follower lever 215 is configured to move from a first (lower) position to a second (higher) position. According to some embodiments, the follower lever 215 is configured to move rotationally about the axis 260 of the connector rod 220 as shown by reference number 265. According to some embodiments, the follower lever 215 is configured to remain in the first (lower) position as long as there is at least one round 15 in the magazine 10. According to some embodiments, when the last round 15 is fired/ejected from the magazine 10, the magazine follower 20 is configured to move the lifter lever 210 from the first (inactive) position to the second (active) position. When the lifter lever 210 is moved to a second (active) position, the support section 212 causes the follower lever 215 to move to the second (higher) position.

According to some embodiments, when the last round 15 is fired/ejected from the magazine 10, the magazine follower 20 is configured to activate the bolt hold open mechanism assembly 200 by moving the lifter lever 210 from the first (inactive) position to the second (active) position. Moving the lifter lever 210 from the first (inactive) position to the second (active) position causes the follower lever 215 to move to the second (higher) position. Moving the follower lever 215 from the first (lower) position to the second (higher) position causes the connector rod 220 to rotate about the longitudinal axis 260 as shown by reference number 265. Rotation of the connector rod 220 about the longitudinal axis 260 causes the bolt stop 230 to move from the first (open) position to the second (blocking) position. Moving the bolt stop 230 from the first (open) position to the second (blocking) position prevents the bolt 240 and the bolt carrier assembly from moving forward to battery.

According to some embodiments, when the last round 15 is fired/ejected from the magazine 10, the magazine follower 20 is configured to activate the bolt hold open mechanism assembly 200 by moving the lifter lever 210 from the first (inactive) position to the second (active) position. Moving the lifter lever 210 from the first (inactive) position to the second (active) position causes the follower lever 215 to move to the second (higher) position. Moving the follower lever 215 from the first (lower) position to the second (higher) position causes the connector rod 220 to rotate from a first angular position to a second angular position. Rotation of the connector rod 220 from the first angular position to the second angular position causes the bolt stop 230 to move from the first (open) position to the second (blocking) position. Moving the bolt stop 230 from the first (open) position to the second (blocking) position prevents the bolt 240 and the bolt carrier assembly from moving forward to battery.

According to some embodiments, when the user replaces the empty magazine 10 with a magazine containing one or more rounds 15, the user's activation of the thumb-actuated portion 250 manually moves the bolt stop 230 from the second (blocking) position to the first (open) position to allow the bolt 240 and the bolt carrier assembly to move forward to battery. Moving the bolt stop 230 to the first (open) position causes the connector rod 220 to rotate about the longitudinal axis 260 as shown by reference number 265. Rotation of the connector rod 220 about the longitudinal axis 260 causes the follower lever 215 to move from the second (higher) position to the first (lower) position. Moving the follower lever 215 to the first (lower) position causes the lifter lever 210 to move from the first (active) position to the second (inactive) position. Moving the lifter lever 210 to the first (inactive) position resets the bolt hold open mechanism assembly 200 until it is once again activated by the magazine follower 20 after the last round 15 is fired/ejected from the magazine 10.

According to some embodiments, when the user replaces the empty magazine 10 with a magazine containing one or more rounds 15, the user's activation of the thumb-actuated portion 250 manually moves the bolt stop 230 from the second (blocking) position to the first (open) position to allow the bolt 240 and the bolt carrier assembly to move forward to battery. Moving the bolt stop 230 to the first (open) position causes the connector rod 220 to rotate from the second angular position to the first angular position. Rotation of the connector rod 220 from the second angular position to the first angular position causes the follower lever 215 to move from the second (higher) position to the first (lower) position. Moving the follower lever 215 to the first (lower) position causes the lifter lever 210 to move from the first (active) position to the second (inactive) position. Moving the lifter lever 210 to the first (inactive) position resets the bolt hold open mechanism assembly 200 until it is once again activated by the magazine follower 20 after the last round 15 is fired/ejected from the magazine 10.

Figure 8:
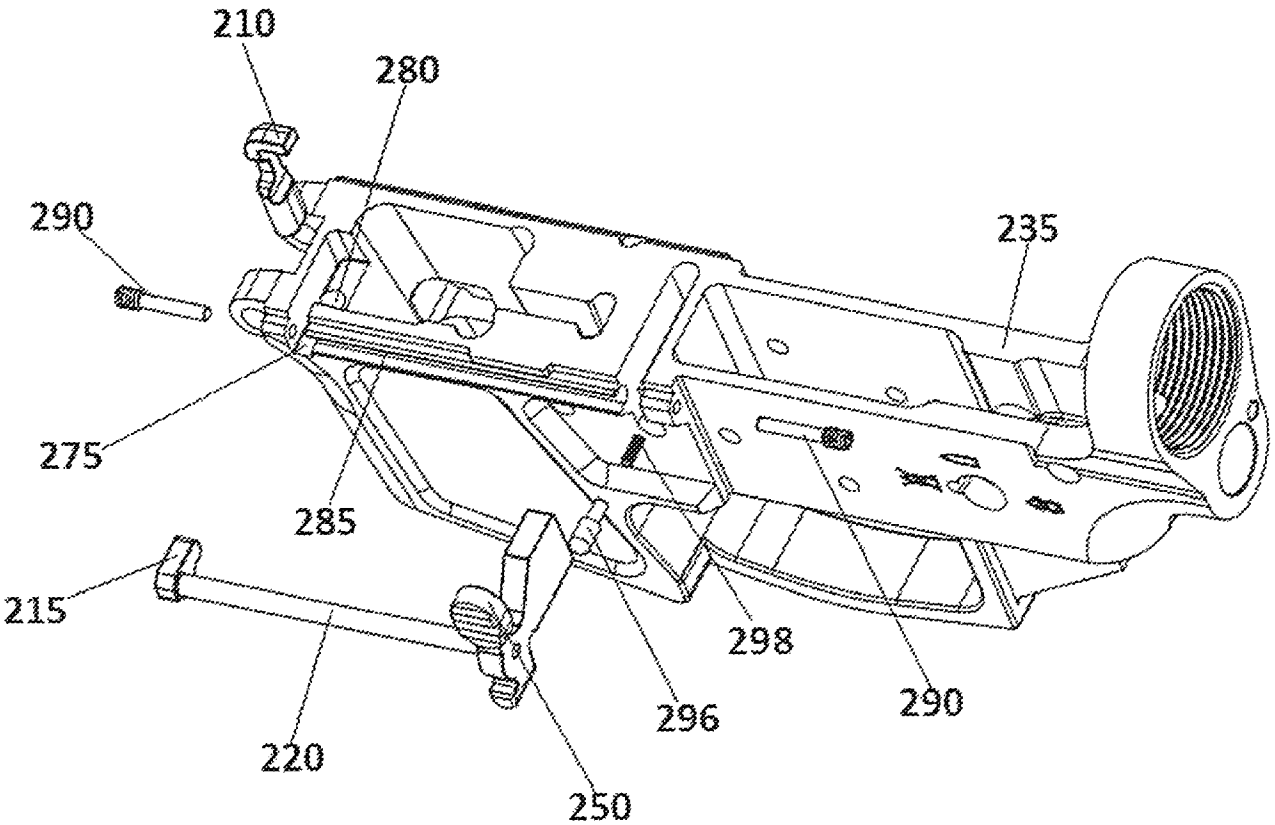
FIG. 8 depicts another sectional perspective of the lower receiver shown in FIG. 7.

Referring to FIG. 8, according to some embodiments, the lower receiver 235 comprises a bolt stop channel 270 to accommodate the bolt stop 230. According to some embodiments, the lower receiver 235 comprises a follower lever channel 275 to accommodate the follower lever 215. According to some embodiments, the lower receiver 235 comprises a lifter lever channel 280 to accommodate the lifter lever 210. According to some embodiments, a portion of the lifter lever 210 is disposed inside the lifter lever channel 280.

Referring to FIG. 8, according to some embodiments, the lower receiver 235 comprises a connector rod channel 285 to accommodate the connector rod 220. The connector rod channel 285 is configured to allow the connector rod 220 to rotate about the axis 260. According to some embodiments, the connector rod channel 285 is configured to allow the connector rod 220 to rotate from the first angular position to the second angular position and vise versa. According to some embodiments, the connector rod channel 285 is disposed on the external side of the lower receiver 235.

According to some embodiments, the bolt stop 230, the connector rod 220 and the follower lever 215 are cast from a single piece of metal (as shown in FIGS. 5-6 and 8). According to some embodiments, the bolt stop 230, the connector rod 220 and the follower lever 215 are cast from a single piece of metal and are coupled with the lower receiver using threaded bolt stop pin 290.

Referring to FIGS. 9-10, according to some embodiments, the bolt stop 230 and the follower lever 215 are coupled with the connector rod 220 using coiled spring pins 294.

According to some embodiments, the bolt hold open mechanism assembly 200 further comprises a bolt stop detent 296 and a bolt stop detent spring 298 to prevent the bolt stop 230 accidently moving to the second (blocking) position during the firing of the gun.

Figure 11:
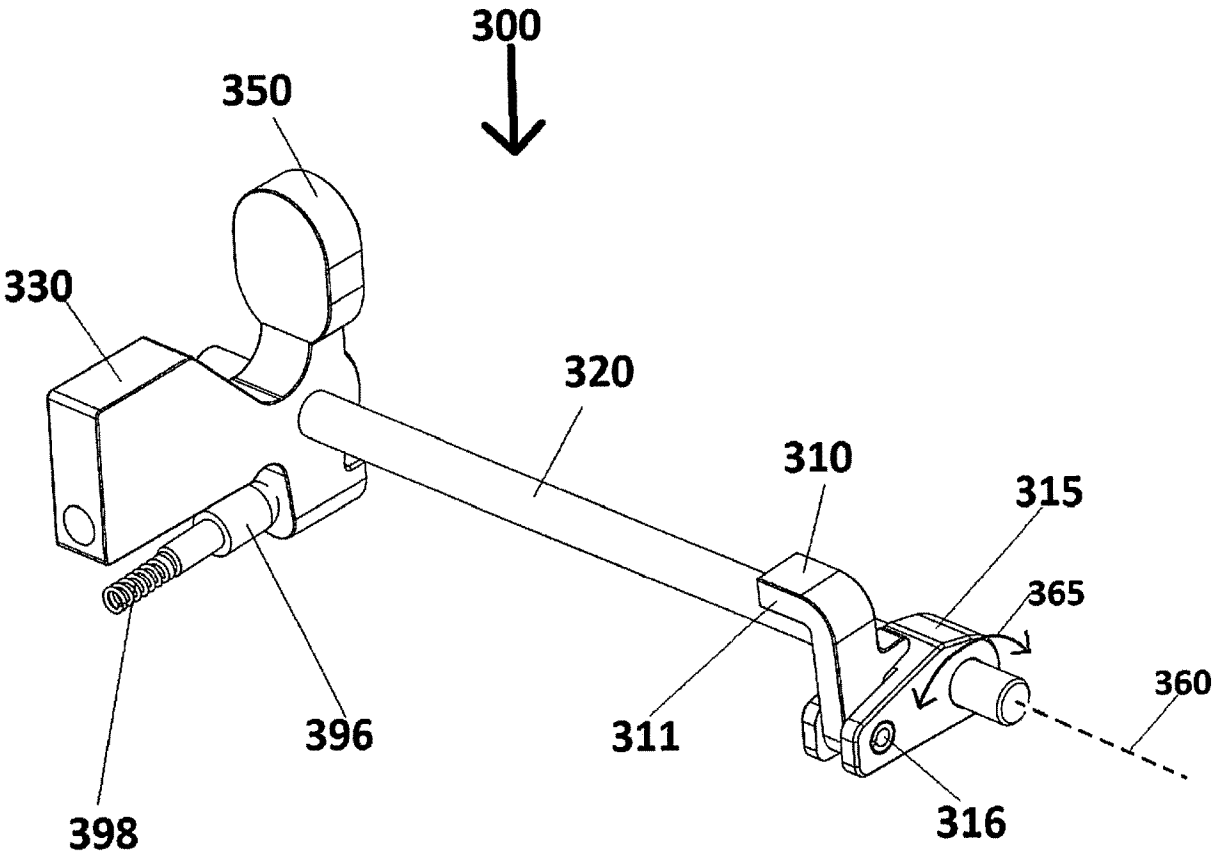
FIG. 11 depicts another bolt hold open mechanism assembly according to the present disclosure.
Figure 12:
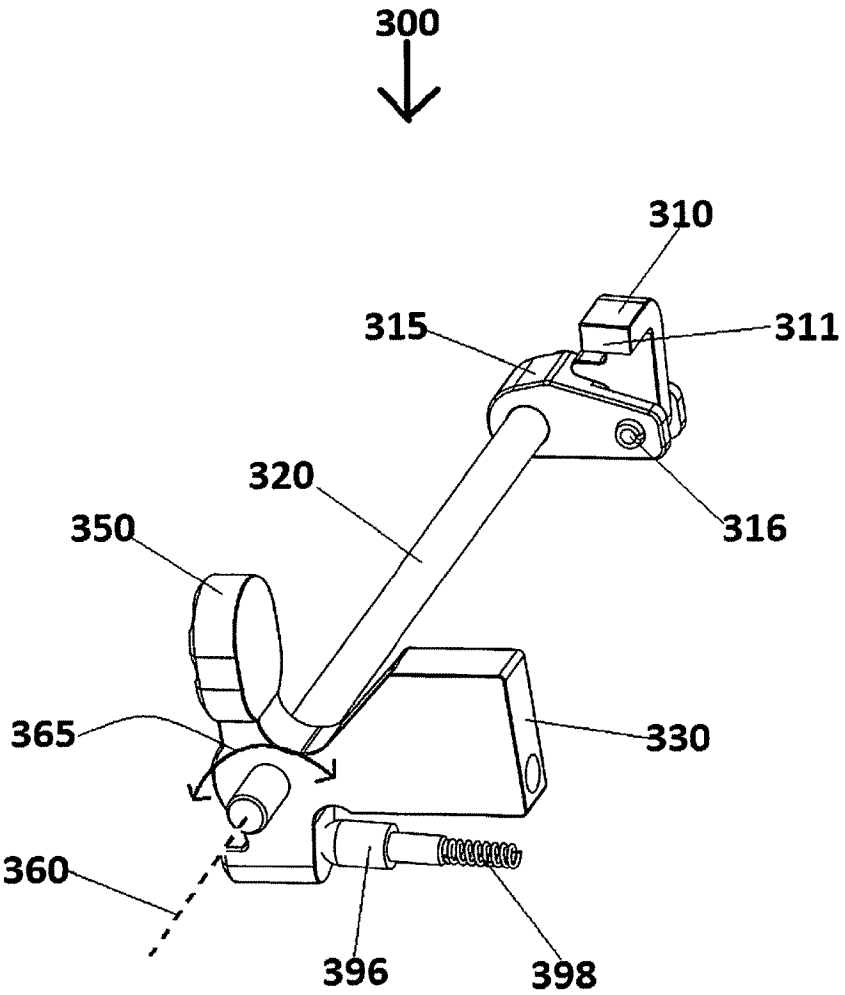
FIG. 12 depicts another view of the bolt hold open mechanism assembly shown in FIG. 11.

Referring to FIGS. 11-12, a bolt hold open mechanism assembly 300 is shown according to some embodiments presently disclosed. The bolt hold open mechanism assembly 300 comprises a lifter lever 310, a follower lever 315, a connector rod 320 and a bolt stop 330. According to some embodiments presently disclosed, the connector rod 320 couples the follower lever 315 with the bolt stop 330. The connector rod 320 comprises a longitudinal axis 360 running along the length of the connector rod 220. The connector rod 320 is configured to rotate about the axis 360 as shown by reference number 365. According to some embodiments, the connector rod 320 is configured to rotate from a first angular position to a second angular position about the axis 360 as shown by reference number 365. The first angular position may be separated from the second angular position by about 15 degrees to 30 degrees.

Figure 14:
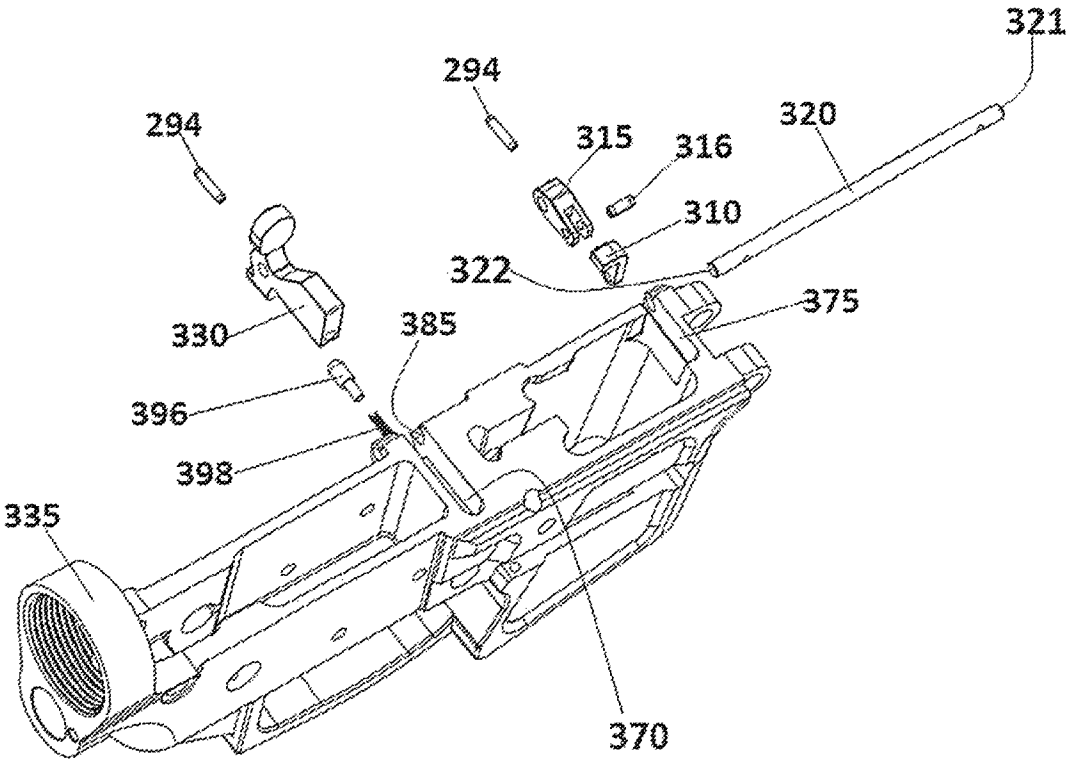
FIG. 14 depicts another sectional perspective of the lower receiver shown in FIG. 13.
Figure 15:
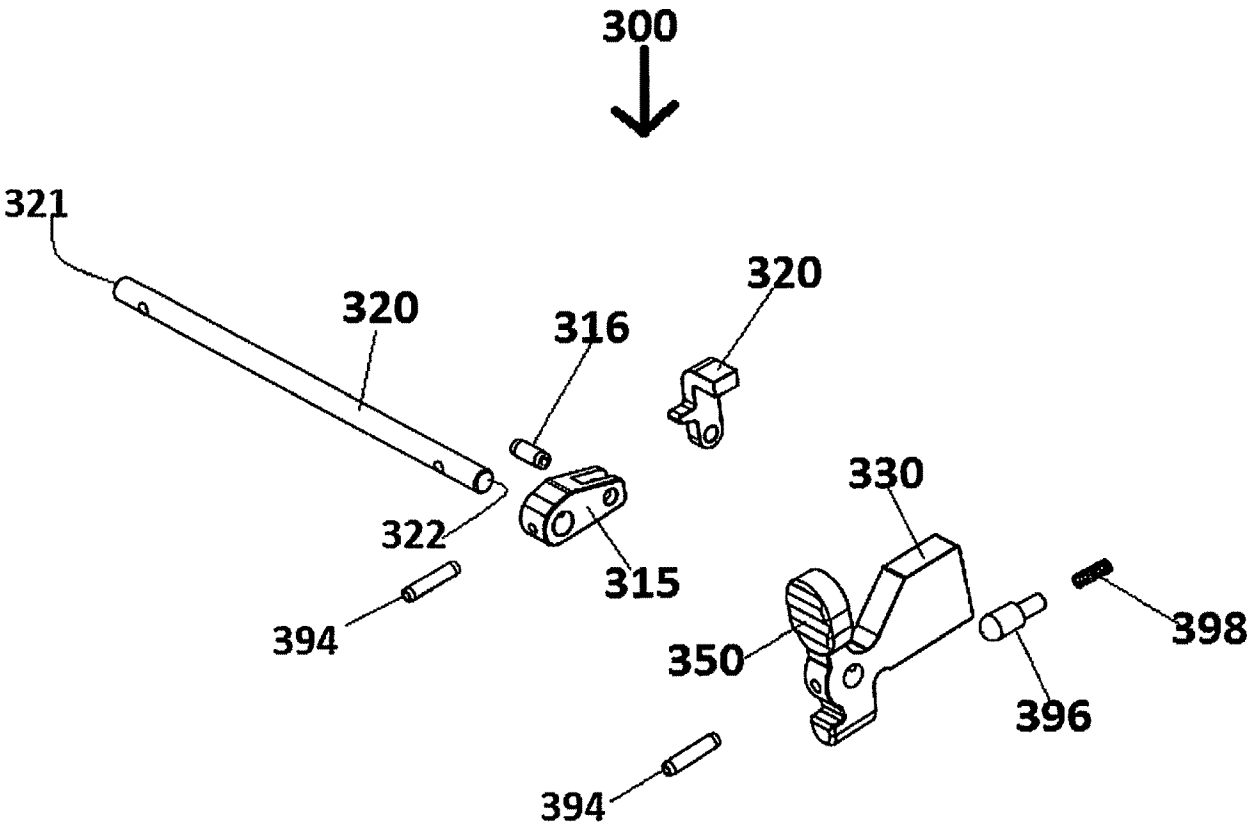
FIG. 15 depicts another bolt hold open mechanism assembly according to the present disclosure.

According to some embodiments, the connector rod 320 comprises a first end 321 and a second end 322 (shown in FIGS. 14-15). According to some embodiments, the lifter lever 310 is positioned adjacent to the first end 321 and the bolt stop 330 is positioned adjacent to the second end 322.

Figure 13:
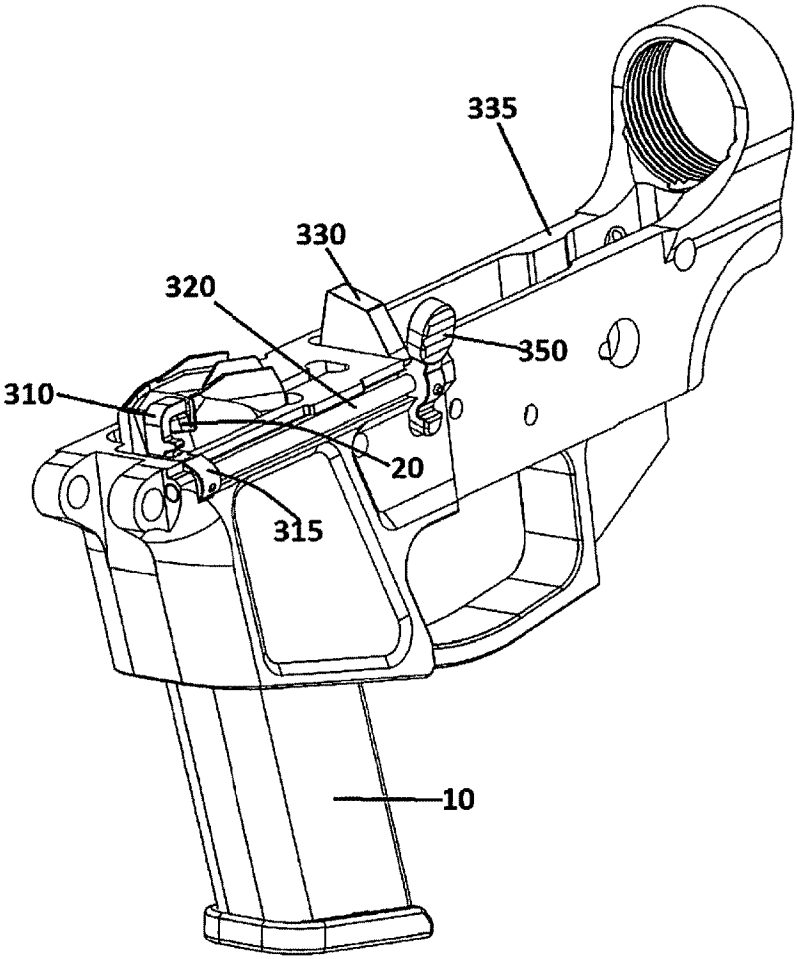
FIG. 13 depicts another sectional perspective of a lower receiver according to the present disclosure.

Referring to FIG. 13, a sectional perspective is shown of a lower receiver 335 with the lifter lever 310 positioned adjacent to the magazine 10 and the bolt stop 330 positioned away from the magazine 10.

The bolt stop 330 is configured to move from a first (open) position to a second (blocking) position. According to some embodiments, at least a portion of the bolt stop 330 moves vertically from the first (open) position to the second (blocking) position. When the bolt stop 330 is in the first (open) position, the bolt (not shown) and the bolt carrier assembly (not shown) are able to freely move forward to battery upon firing and ejecting the rounds 15. When the bolt stop 330 is in the second (blocking) position, the bolt and the bolt carrier assembly are prevented from moving forward to battery. The bolt stop 330 may also comprise a thumb-actuated portion 350 to allow the user (i.e. operator of the firearm) to manually move the bolt stop 330 between the first (open) and second (blocking) positions and back. According to some embodiments, the bolt stop 330 is configured to move rotationally about the axis 360 of the connector rod 320 as shown by reference number 365.

According to some embodiments, the lifter lever 310 is configured to move from a first (inactive) position to a second (active) position. According to some embodiments, the lifter lever 310 is configured to move vertically between the first (inactive) position and the second (active) position. According to some embodiments, the lifter lever 310 is configured to remain in the first (inactive) position as long as there is at least one round 15 in the magazine 10. According to some embodiments, when the last round 15 is fired/ejected from the magazine 10, the magazine follower 20 is configured to move the lifter lever 310 from the first (inactive) position to the second (active) position. According to some embodiments, the lifter lever 310 comprises at least one protrusion 311 configured to interact with the magazine follower 20 when the last round 15 is fired/ejected from the magazine 10. According to some embodiments, when the last round 15 is fired/ejected from the magazine 10, the magazine follower 20 is configured to interact with the protrusion 311 and move the lifter lever 310 from the first (inactive) position to the second (active) position.

According to some embodiments, a portion of the lifter lever 310 interacts with the magazine follower 20 when the last round 15 is fired/ejected from the magazine 10. According to some embodiments, when the last round 15 is fired/ejected from the magazine 10, the magazine follower 20 is configured to interact with the portion of the lifter lever 310 and move the lifter lever 310 from the first (inactive) position to the second (active) position.

According to some embodiments, at least a portion of the follower lever 315 is configured to move from a first (lower) position to a second (higher) position. According to some embodiments, the follower lever 315 is configured to move rotationally about the axis 360 of the connector rod 320 as shown by reference number 365. According to some embodiments, the follower lever 315 is configured to remain in the first (lower) position as long as there is at least one round 15 in the magazine 10. According to some embodiments, when the last round 15 is fired/ejected from the magazine 10, the magazine follower 20 is configured to move the lifter lever 310 from the first (inactive) position to the second (active) position. When the lifter lever 310 is moved to a second (active) position, the lifter lever 310 causes the follower lever 315 to move to the second (higher) position.

According to some embodiments, the lifter lever 310 is pivotally coupled with the follower lever 315 using, for example, coiled spring pin 316.

According to some embodiments, when the last round 15 is fired/ejected from the magazine 10, the magazine follower 20 is configured to activate the bolt hold open mechanism assembly 300 by moving the lifter lever 310 from the first (inactive) position to the second (active) position. Moving the lifter lever 310 from the first (inactive) position to the second (active) position causes the follower lever 315 to move to the second (higher) position. Moving the follower lever 315 from the first (lower) position to the second (higher) position causes the connector rod 320 to rotate about the longitudinal axis 360 as shown by reference number 365. Rotation of the connector rod 320 about the longitudinal axis 360 causes the bolt stop 330 to move from the first (open) position to the second (blocking) position. Moving the bolt stop 330 from the first (open) position to the second (blocking) position prevents the bolt and the bolt carrier assembly from moving forward to battery.

According to some embodiments, when the last round 15 is fired/ejected from the magazine 10, the magazine follower 20 is configured to activate the bolt hold open mechanism assembly 300 by moving the lifter lever 310 from the first (inactive) position to the second (active) position. Moving the lifter lever 310 from the first (inactive) position to the second (active) position causes the follower lever 315 to move to the second (higher) position. Moving the follower lever 315 from the first (lower) position to the second (higher) position causes the connector rod 320 to rotate from a first angular position to a second angular position. Rotation of the connector rod 320 from the first angular position to the second angular position causes the bolt stop 330 to move from the first (open) position to the second (blocking) position. Moving the bolt stop 330 from the first (open) position to the second (blocking) position prevents the bolt and the bolt carrier assembly from moving forward to battery.

According to some embodiments, when the user replaces the empty magazine 10 with a magazine containing one or more rounds 15, the user's activation of the thumb-actuated portion 250 manually moves the bolt stop 330 from the second (blocking) position to the first (open) position to allow the bolt and the bolt carrier assembly to move forward to battery. Moving the bolt stop 330 to the first (open) position causes the connector rod 320 to rotate about the longitudinal axis 360 as shown by reference number 365. Rotation of the connector rod 320 about the longitudinal axis 360 causes the follower lever 315 to move from the second (higher) position to the first (lower) position. Moving the follower lever 315 to the first (lower) position causes the lifter lever 310 to move from the first (active) position to the second (inactive) position. Moving the lifter lever 310 to the first (inactive) position resets the bolt hold open mechanism assembly 300 until it is once again activated by the magazine follower 20 after the last round 15 is fired/ejected from the magazine 10.

According to some embodiments, when the user replaces the empty magazine 10 with a magazine containing one or more rounds 15, the user's activation of the thumb-actuated portion 250 manually moves the bolt stop 330 from the second (blocking) position to the first (open) position to allow the bolt and the bolt carrier assembly to move forward to battery. Moving the bolt stop 330 to the first (open) position causes the connector rod 320 to rotate from the second angular position to the first angular position. Rotation of the connector rod 320 from the second angular position to the first angular position causes the follower lever 315 to move from the second (higher) position to the first (lower) position. Moving the follower lever 315 to the first (lower) position causes the lifter lever 310 to move from the first (active) position to the second (inactive) position. Moving the lifter lever 310 to the first (inactive) position resets the bolt hold open mechanism assembly 300 until it is once again activated by the magazine follower 20 after the last round 15 is fired/ejected from the magazine 10.

Referring to FIG. 14, according to some embodiments, the lower receiver 335 comprises a bolt stop channel 370 to accommodate the bolt stop 330. According to some embodiments, the lower receiver 335 comprises a follower lever channel 375 to accommodate the follower lever 315 and the lifter lever 310.

Referring to FIG. 14, according to some embodiments, the lower receiver 335 comprises a connector rod channel 385 to accommodate the connector rod 320. The connector rod channel 385 is configured to allow the connector rod 320 to rotate about the axis 360. According to some embodiments, the connector rod channel 385 is configured to allow the connector rod 320 to rotate from the first angular position to the second angular position and vise versa. According to some embodiments, the connector rod channel 385 is disposed on the external side of the lower receiver 335.

According to some embodiments, the bolt stop 330, the connector rod 320 and the follower lever 315 are cast from a single piece of metal (as shown in FIG. 11).

Referring to FIGS. 14-15, according to some embodiments, the bolt stop 330 and the follower lever 315 are coupled with the connector rod 320 using coiled spring pins 394.

Although the connector rod 120 is shown having a circular cross section, it is to be understood that it can be any cross section that would allow the connector rod 120 to rotate from a first angular position to a second angular position and vise versa about the axis 160 as shown by reference number 165. For example, the connector rod 120 may comprise a circular cross section, an oval cross section, a semicircular cross section, star cross section, multisided cross section, or a combination of these cross sections.

Although the connector rod 220 is shown having a circular cross section, it is to be understood that it can be any cross section that would allow the connector rod 220 to rotate from a first angular position to a second angular position and vise versa about the axis 260 as shown by reference number 265. For example, the connector rod 220 may comprise a circular cross section, an oval cross section, a semicircular cross section, star cross section, multisided cross section, or a combination of these cross sections.

Although the connector rod 320 is shown having a circular cross section, it is to be understood that it can be any cross section that would allow the connector rod 320 to rotate from a first angular position to a second angular position and vise versa about the axis 360 as shown by reference number 365. For example, the connector rod 320 may comprise a circular cross section, an oval cross section, a semicircular cross section, star cross section, multisided cross section, or a combination of these cross sections.

It is to be understood that parts of the above disclosed bolt hold open mechanism assembly 100, 200 and/or 300 may comprise metal material, polymeric material, plastic material, aluminum material, steel material, or a combination of any of these materials.

According to some embodiments, the bolt hold open mechanism assembly 300 further comprises a bolt stop detent 396 and a bolt stop detent spring 398 to prevent the bolt stop 330 accidently moving to the second (blocking) position during the firing of the gun.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A bolt hold open mechanism assembly comprising: a connector rod configured to rotate from a first angular position to a second angular position, wherein the connector rod comprises a first end and a second end; and a bolt stop, wherein at least a portion of the bolt stop is configured to move from an open position to a blocking position; wherein the at least the portion of the bolt stop moves to the blocking position when the connector rod rotates to the second angular position; wherein the bolt stop is coupled directly with the second end of the connector rod.

2. The bolt hold open mechanism assembly of claim 1, wherein the connector rod and the bolt stop are cast from a single piece of metal.

3. The bolt hold open mechanism assembly of claim 1, wherein the bolt stop comprises an aperture configured to accommodate the connector rod.

4. A bolt hold open mechanism assembly comprising: a connector rod configured to rotate from a first angular position to a second angular position, wherein the connector rod comprises a first end and a second end; and a bolt stop, wherein at least a portion of the bolt stop is configured to move from an open position to a blocking position; wherein rotation of the connector rod to the second angular position causes the at least the portion of the bolt stop to move to the blocking position; wherein the bolt stop comprises and aperture configured to accommodate the connector rod.

5. The bolt hold open mechanism assembly of claim 4, wherein the bolt stop is coupled directly to the connector rod.

* * * * *